US007024015B2

(12) United States Patent
Hasegawa et al.

(10) Patent No.: US 7,024,015 B2
(45) Date of Patent: Apr. 4, 2006

(54) SPEAKER AND METHOD OF MANUFACTURING THE SPEAKER

(75) Inventors: Akinori Hasegawa, Hyogo (JP); Fumiyasu Konno, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 233 days.

(21) Appl. No.: 10/380,043

(22) PCT Filed: Jul. 17, 2002

(86) PCT No.: PCT/JP02/07261

§ 371 (c)(1),
(2), (4) Date: Jul. 29, 2003

(87) PCT Pub. No.: WO03/009641

PCT Pub. Date: Jan. 30, 2003

(65) Prior Publication Data

US 2004/0037446 A1 Feb. 26, 2004

(30) Foreign Application Priority Data

Jul. 19, 2001 (JP) ..... 2001-219381

(51) Int. Cl.
*H04R 25/00* (2006.01)

(52) U.S. Cl. ..... 381/412; 381/396; 381/398

(58) Field of Classification Search ..... 381/396–398, 381/411–412, 414
See application file for complete search history.

(56) References Cited

U.S. PATENT DOCUMENTS

| | | | | |
|---|---|---|---|---|
| 3,801,943 | A * | 4/1974 | Bertagni | 381/398 |
| 4,210,778 | A * | 7/1980 | Sakurai et al. | 381/397 |
| 4,757,547 | A * | 7/1988 | Danley | 381/397 |
| 4,933,975 | A * | 6/1990 | Button | 381/397 |
| 5,475,765 | A * | 12/1995 | Lyth | 381/397 |
| 6,639,993 | B1 * | 10/2003 | Kemmerer et al. | 381/397 |

FOREIGN PATENT DOCUMENTS

| | | |
|---|---|---|
| JP | 50-14437 | 2/1975 |
| JP | 63-196199 | 12/1988 |
| JP | 2940236 | 6/1999 |
| JP | 2001-36989 | 2/2001 |
| WO | 02/065811 | 8/2002 |

* cited by examiner

*Primary Examiner*—Suhan Ni
(74) *Attorney, Agent, or Firm*—Wenderoth, Lind & Ponack, L.L.P.

(57) ABSTRACT

The speaker disclosed in this invention comprises: (a) a central cap fixed on voice coil bobbin; (b) a shaft fixed in the center of the central cap; and (c) a bearing filled with lubricating fluid and fixed in a through-hole disposed in the center of a magnetic circuit. The speaker has excellent characteristics without sliding noise or harmful rolling phenomena but with reduced harmonic distortion due to the introduction of a magnetic fluid or a lubricant used as a lubricating fluid.

20 Claims, 11 Drawing Sheets

SPEAKER AND METHOD OF MANUFACTURING THE SPEAKER

TECHNICAL FIELD

The present invention relates to a dynamic speaker for use in audio system and the like and the manufacturing method.

BACKGROUND ART

Dynamic speakers are well known in the art as one of acoustic transducers used to reproduce sound of music and voice. Now, conventional speaker is described as follows with reference to drawings.

A conventional speaker comprises; (a) top yoke 1, (b) magnet 2, (c) bottom yoke 3 mounted on bottom surface of magnet 2, (d) central pole 4 incorporated with bottom yoke 3, (e) frame 6, (f) voice coil 71 wound on voice coil bobbin 72, (g) damper 19 to fix external circumference of voice coil bobbin 72 on frame 6, (h) diaphragm 10 having internal circumference fixed on voice coil bobbin 72 and external circumference fixed on edge 11 (described later), (i) edge 11 having internal circumference fixed to diaphragm 10 and external circumference fixed to frame 6 and (j) central cap 8 fixed in the center of diaphragm 10.

Then, function of a speaker with above configuration is described. Current passed through voice coil 71 wound on voice coil bobbin 72 generates electro-magnetic force perpendicular to both magnetic field direction and current direction respectively according to Fleming's Law, as the direction of the current is orthogonal to magnetic field provided inside of magnetic space built by top yoke 1 and central pole 4. Subsequently, damper 19 and edge 11 hold voice coil 71 so that the voice coil and the central pole 4 have same center axis. And when diaphragm vibrates, damper 19 and edge 11 act as springs in an amplitude direction for bringing togather a midpoint in thickeness direction of top yoke 1 and a midpoint of winding width of voice coil 71. When AC current is passed through voice coil 71, voice coil bobbin 72 and diaphragm 10 vibrate being held by damper 19 and edge 11. The vibratory motion causes air vibration to produce compressional wave as an audible sound.

However, this configuration has following drawbacks.

Firstly, vibration system does not perform an ideal piston movement but causes rolling phenomena (left-to-right rocking), due to asymmetric holding strength of damper 19 or edge 11, or asymmetric back pressure occured on diaphragm 10 when a speaker is set in a box to reproduce sounds. Whole of diaphragm 10 does not move in-phase but moves reverse phase partially during a rolling phenomena, consequently disturbance occurs in a frequency characteristics of the sound pressure as shown in FIG. 15.

Secondly, harmonic distortion occurs in frequency characteristics of the sound pressure as shown curve (b) and curve (c) in FIG. 15, as damper 19 has a non-linear relation between applied force and displacement and has a hysteresis characteristics, as well.

To solve these problems, a speaker has been disclosed in Japanese Patent No.2940236 that uses shaft and bearing instead of a damper to support piston movement of up-and-down vibration. In this disclosure, however, a problem is an occurrence of noisy sound between shaft and bearing.

DISCLOSURE OF INVENTION

The present invention aims at providing a speaker and a manufacturing method thereof that can solve above-mentioned drawbacks. The speaker can prevent rolling phenomena and sliding noise, and need not use a damper that causes harmonic distortion due to non-linearity.

A speaker disclosed for the purpose comprises:

(a) a magnetic circuit having a ring shaped top yoke, a ring shaped magnet, a bottom yoke, a central pole and the bottom yoke incorporated with the pole, (b) a frame fixed to the magnetic circuit, (c) a diaphragm fixed to the frame, (d) a voice coil wound on a bobbin provided internal circumference of the diaphragm, (e) a central cap fixed on the bobbin of the voice coil, (f) a shaft fixed in the center of the central cap, (g) a bearing fixed in a through-hole provided in the center of the magnetic circuit and placed in a position on the central pole where leakage flux shows its maximum value, and hold the shaft, and (h) a magnetic fluid filled in a gap between shaft and bearing.

The speaker shows an excellent performance with the magnetic fluid to prevent sliding noise between shaft and bearing, while having no rolling phenomena and less harmonic distortion.

BEST MODE FOR CARRYING OUT THE INVENTION

Figure 1:
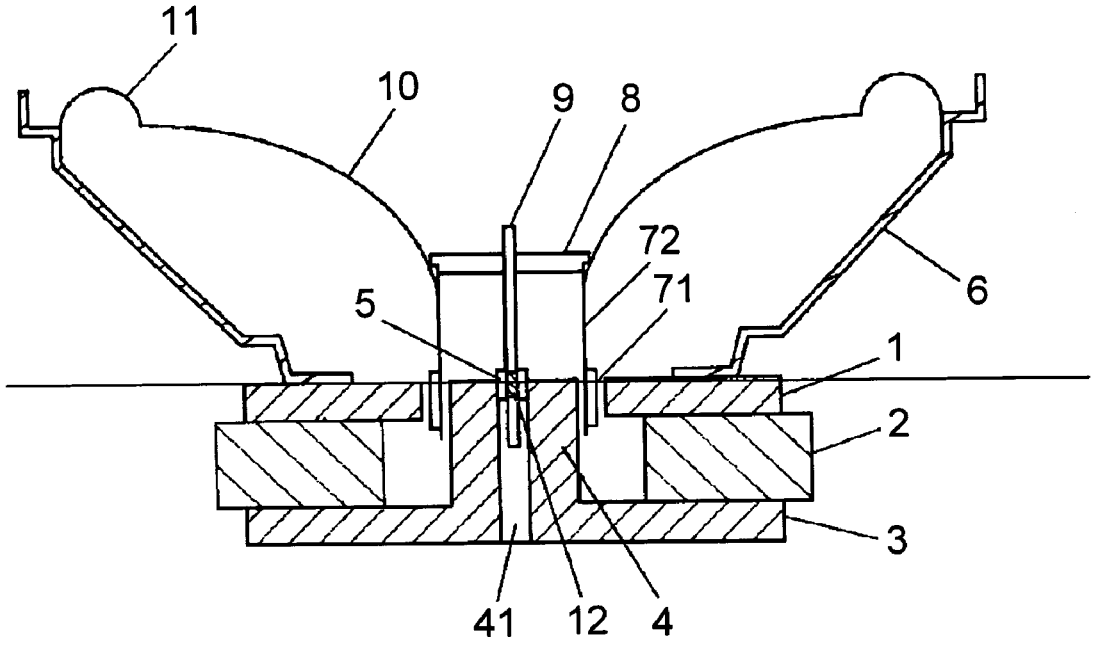
FIG. 1 illustrates a cross sectional view showing a speaker used in exemplary embodiment 1 of the present invention.

The speaker disclosed in this invention comprises a central cap fixed on voice coil bobbin and a shaft fixed in the center of the central cap.

A bearing filled with (1) a magnetic fluid or (2) a lubricant is fixed to through-hole provided in the center of the magnetic circuit at a place on the central pole where leakage flux shows its maximum value. The speaker shows a high performance with (1) a magnetic fluid or (2) a lubricant to prevent sliding noise between shaft and bearing, while having no rolling phenomena and less harmonic distortion.

Another aspect of this invention is to provide a bearing with a reservoir for a magnetic fluid or a lubricant capable of keeping a specific quantity of the magnetic fluid or the lubricant. This configuration can produce a speaker having little aging distortion.

Still another aspect of this invention is to provide a bearing composed of a self-lubricating resin. This configuration can prevent noisy sound of shaft sliding for a long time.

Still another aspect of this invention is to provide a shaft composed of a non-magnetic. This configuration can perform smooth up and down vibrational movement.

Still another aspect of this invention is to provide a shaft composed of a magnetic material. This configuration can prevent vibration from damping due to electro-magnetic damping effect.

Still another aspect of this invention is to provide a shaft diameter with a range from 1 mm to 3 mm. This configuration can minimize a decrease of sound pressure due to weight increase of vibration system.

Still another aspect of this invention is to provide a clearance between bearing and shaft ranging from 0.008 mm to 0.015 mm. This configuration can minimize generation of sliding noise.

Still another aspect of this invention is to control magnetic fluid viscosity. This configuration can adjust sharpness of speaker resonance (Q).

Still another aspect of this invention is to provide a through-hole of central pole with a seal composed of a porous material. This configuration can prevent ingress from coming into the through-hole, while permeability is being maintained.

Still another aspect of this invention is to provide a bearing mounted on both ends of a cylindrical metal with a specific gap. This configuration can increase assembling accuracy of a speaker.

Still another aspect of this invention is to provide a silicone based lubricant or fluorine-containing lubricant. This configuration also can prevent sliding noise for a long time.

Still another aspect of this invention is to provide a manufacturing method of a speaker with a high accuracy comprising the steps of:

(a) fixing central cap on a voice coil provided internal circumference of diaphragm;

(b) preparing beforehand a vibration system parts having shaft fixed in the center of central cap;

(c) preparing beforehand a field magnet parts having a bearing filled with magnetic fluid or lubricant in the center of central pole of the magnetic circuit; and (d) fixing external circumference of diaphragm on frame consisting field magnet parts using a bearing fixed in the center of central pole of magnetic circuit as a guide for assembling.

Now, exemplary embodiment of this invention is described with reference to FIGS. 1 to 12.

Exemplary Embodiment 1

Figure 2:
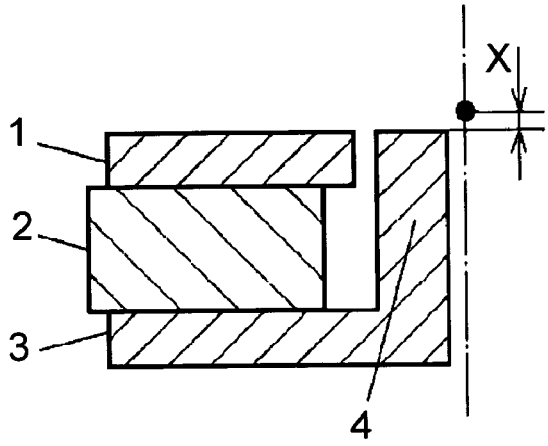
FIG. 2 illustrates a cross sectional view showing a distance from central pole of a speaker used in exemplary embodiment 1 of the present invention.
Figure 3:
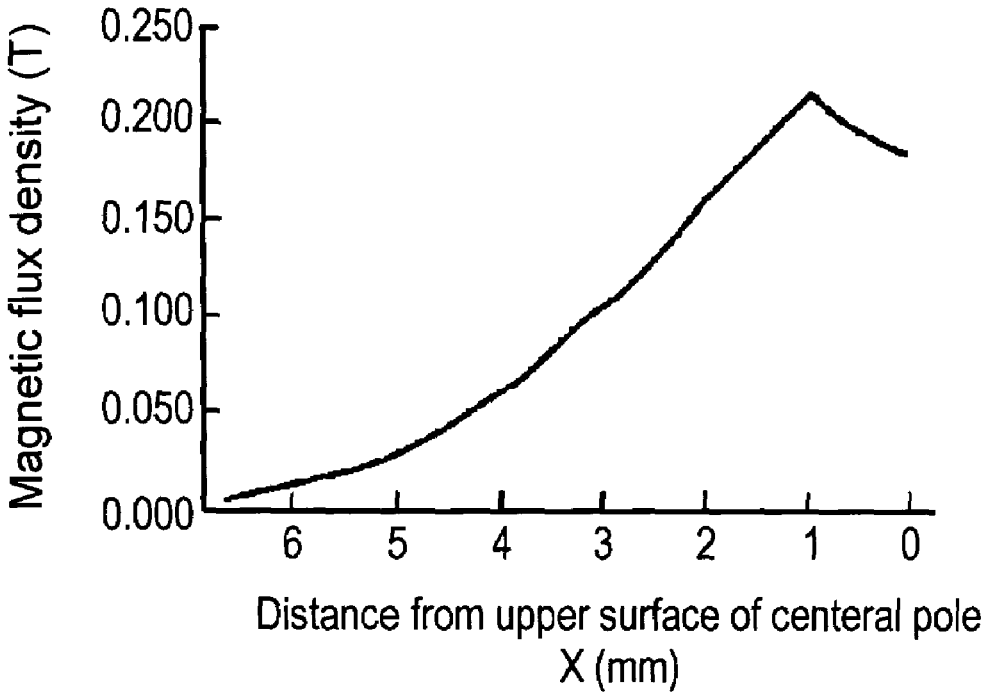
FIG. 3 illustrates a characteristic showing a variation of leakage flux at point X from central pole of a speaker used in exemplary embodiment 1 of the present invention.

FIG. 1 is a cross-sectional view showing a structure of a speaker used in exemplary embodiment 1. FIG. 2 is a cross-sectional view of an important part of a speaker used in exemplary embodiment 1. FIG. 3 is a characteristic of a speaker used in exemplary embodiment 1.

A speaker disclosed in this invention comprises: (a) ring shaped top yoke 1, (b) ring shaped magnet 2, (c) bottom yoke 3 coupled to central pole 4, (d) frame 6 fixed to top yoke 1, (e) voice coil 71 wound on a bobbin 72 provided internal circumference of diaphragm 10. Central cap 8 fixed to internal circumference of voice coil 71 is coupled to bobbin so that upper end of bobbin is capped.

Moreover, the speaker comprises: (f) shaft 9 fixed in the center of central cap 8, (g) edge 11 provided on external circumference of diaphragm 10 and fixed to frame 6, and (h) a magnetic fluid 12 filled in a gap between shaft 9 and bearing 5, as shown in FIG. 1.

FIG. 2 shows a position, apart from upper surface of central pole 4 by distance X, where a leakage flux is measured. FIG. 3 shows the measurement results.

As shown in FIG. 3, leakage flux shows its maximum value at a position apart from upper surface of central pole 4 by 1 mm in exemplary embodiment 1. Bearing 5 placed in this position can hold magnetic fluid 12 and prevent the fluid from scattering when shaft 9 slides.

Bearing 5 through which shaft 9 penetrates is housed in through-hole 41 provided in the center of central pole 4.

Figure 4:
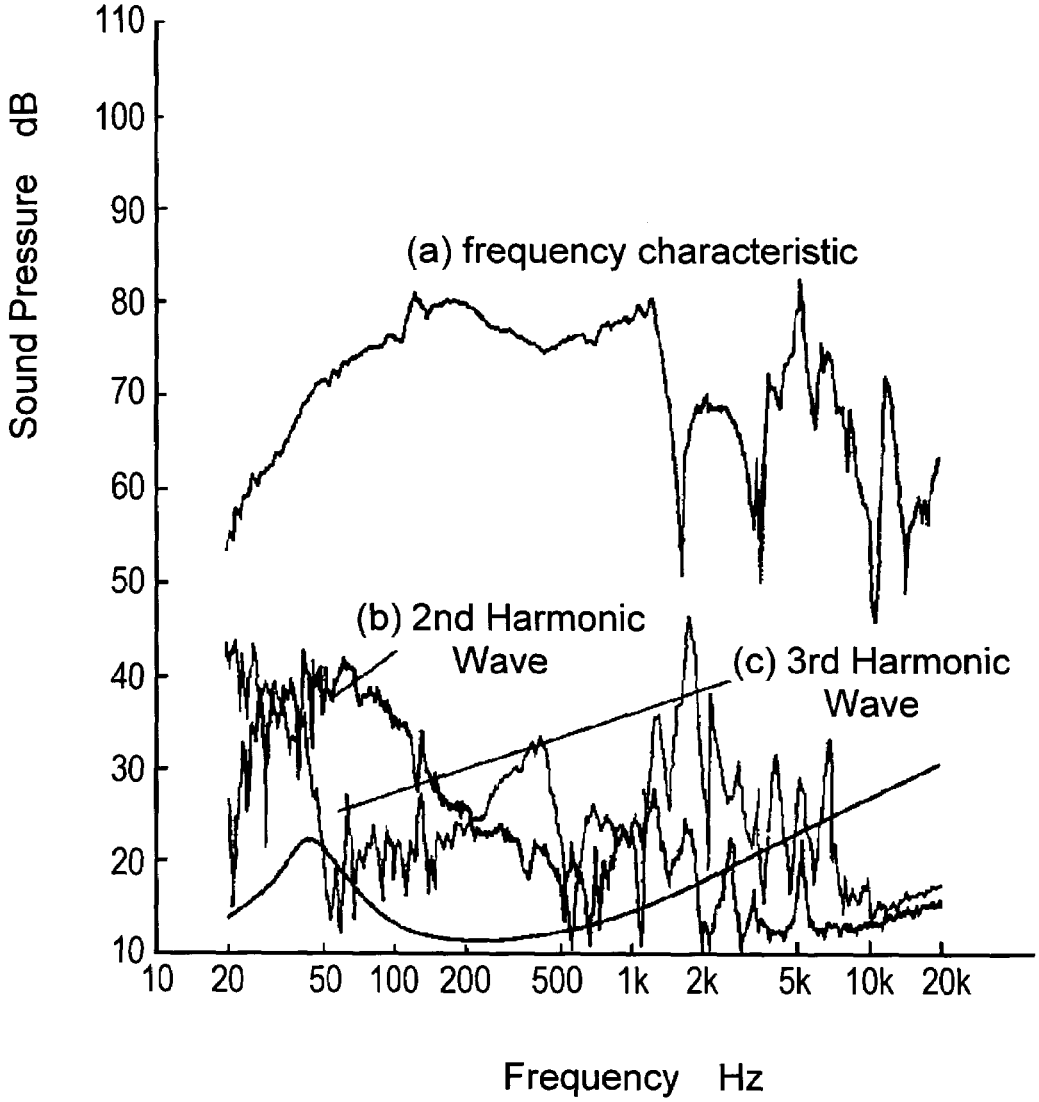
FIG. 4 illustrates a characteristic of a speaker used in exemplary embodiment 1 of the present invention.
Figure 15:
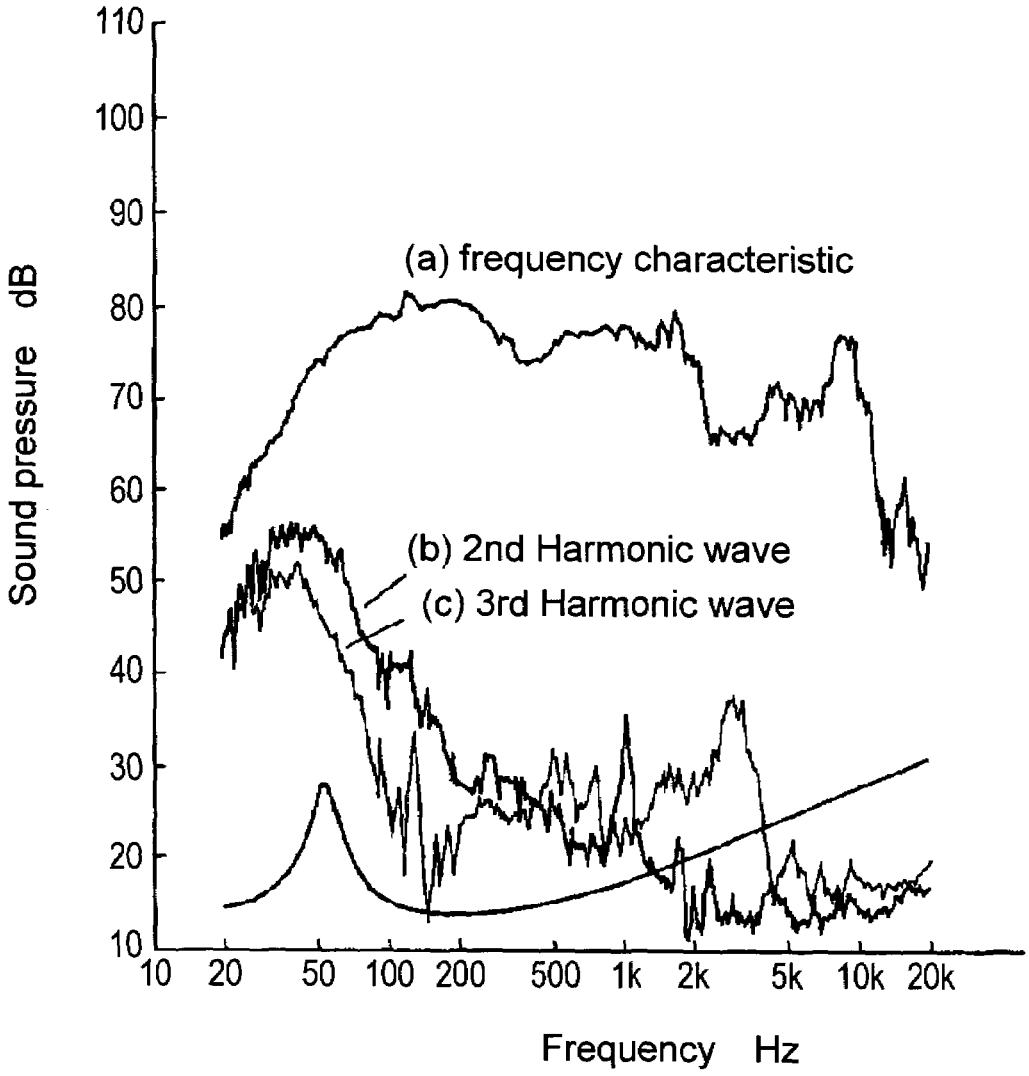
FIG. 15 illustrates a characteristic of a conventional speaker.

FIG. 4 illustrates frequency characteristics of sound pressure and harmonic distortion of a speaker used in exemplary embodiment 1. Comparrison of FIG. 4 with FIG. 15 clearly shows that both of second harmonic distortion (curve b) and third harmonic distortion (curve c) decrease remarkably.

As mentioned in above exemplary embodiment 1, a configuration using no damper can produce a speaker with excellent performance without occurrence of any sliding noise.

Figure 5:
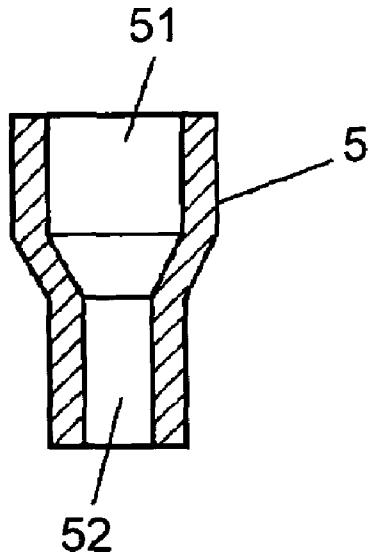
FIG. 5 illustrates a cross sectional view of a bearing used in exemplary embodiment 1 of the present invention.

FIG. 5 shows structure of bearing 5 used in exemplary embodiment 1. Bearing 5 disclosed in this invention has such a structure that upper portion 51 having larger bore diameter acts as magnetic fluid reservoir, and bottom portion 52 having smaller bore diameter acts as bearing.

This configuration enables to pour a specific quantity of magnetic fluid 12 into bearing easily, and workability is improved as a result.

Another configuration in exemplary embodiment 1 is bearing 5 composed of self-lubricating resin. Self-lubricating resin composed of polyacetal resin or polyolefine resin in which lubricant and special filler are dispersed homogeneously can be used as lubricant-free bearing.

Oil component exuded from self-lubricating resin can prevent sliding noise, if friction between shaft 9 and bearing 5 increases. Additionally, this invention is not limited to the above-mentioned specific resins, but any polymeric material having same effect can also be used.

Another configuration in exemplary embodiment 1 is shaft 9 composed of non-magnetic metal. The shaft enables smooth vertical motion without influenced by magnetic leakage flux around central pole 4.

Figure 6:
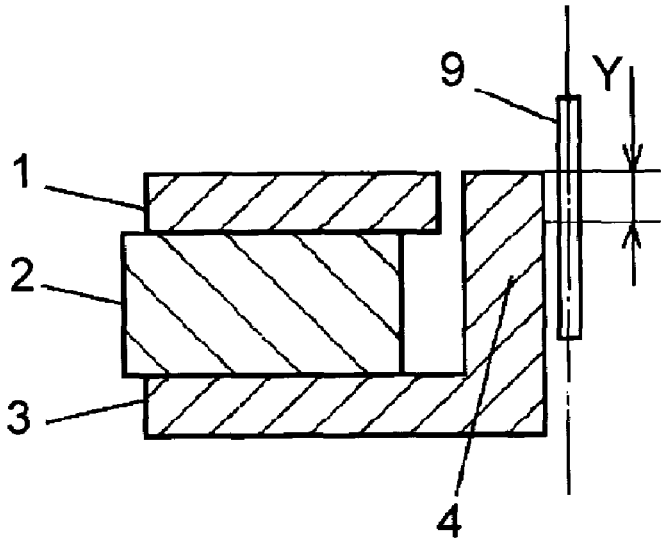
FIG. 6 illustrates a cross sectional view explaining embodiment 1 of the present invention.
Figure 7:
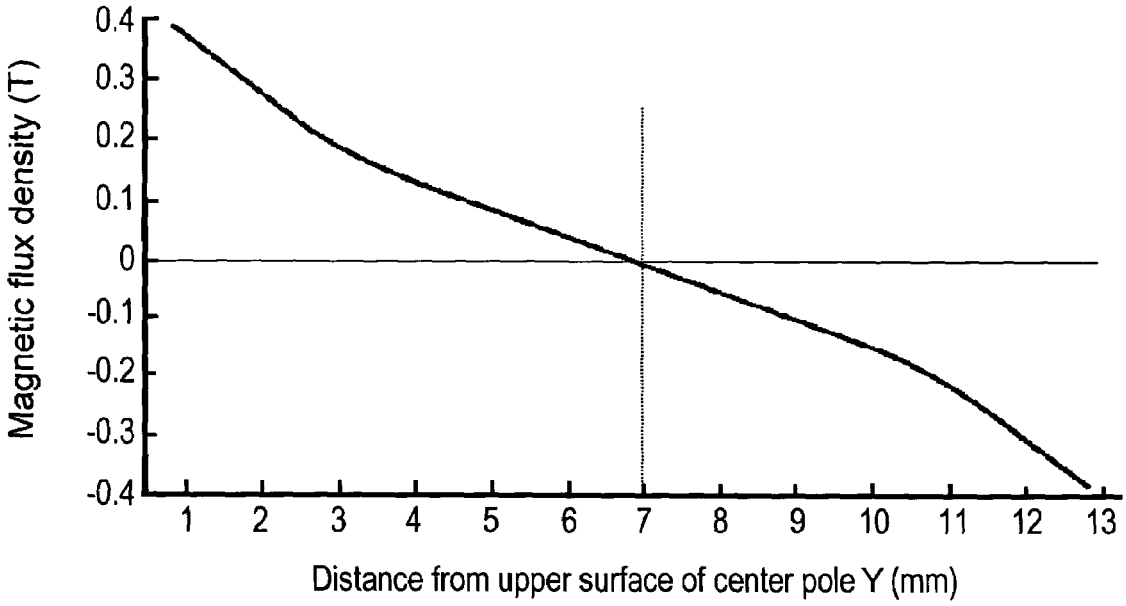
FIG. 7 illustrates a characteristic view showing a magnetic stress applied on a shaft used in exemplary embodiment 1 of the present invention.

Another configuration in exemplary embodiment 1 is shaft 9 composed of magnetic metal as shown in FIG. 6. Inserted depth of shaft 9 into through-hole 41 of central pole 4 has a significant meaning in this case. Inserted depth Y denotes displacement from upper surface of central pole, when upper surface of central pole 4 and center of shaft 9 in same level is specified as reference line (i.e. Y=0). FIG. 6 illustrates inserted depth Y. FIG. 7 shows a simulation result of magnetic stress applied on shaft 9, when inserted gradually. The simulation shows that there is a point at a depth Y from upper surface of central pole 4 where no magnetic stress is applied on shaft 9 and that a substantially same amount of magnetic stress is applied upwardly and downwardly. Consequently, shaft 9 composed of magnetic metal disclosed in exemplary embodiment 1 stays at a position inserted into through-hole 41 from upper surface of central pole 4 by 7 mm where magnetic stress shows 0 value and shaft is in a magnetically balanced condition. The configuration capable of vertical vibration with the point as a center can provide with a damping effect by so called electro-magnetic damping phenomena. Therefore, the larger a vibrational amplitude is, the larger a magnetic stress on the vibration system becomes.

Another configuration in exemplary embodiment 1 is setting of shaft 9 diameter from 1 mm to 3 mm. Diameter size within the range can minimize weight increase in the vibration system, and a high performance speaker is obtained without a ramarkable decrease of sound pressure.

Another configuration in exemplary embodiment 1 is to provide a clearance between bearing and shaft ranging from 0.008 mm to 0.015 mm. Clearance within the range can suppress increase in sliding noise due to long time vibration or ambient temperature cycling, and can produce a speaker with high reliability.

Another configuration in exemplary embodiment 1 is to control viscosity of magnetic fluid 12 filled into a gap between shaft 9 and bearing 5 to control damping factor of a speaker.

Figure 8:
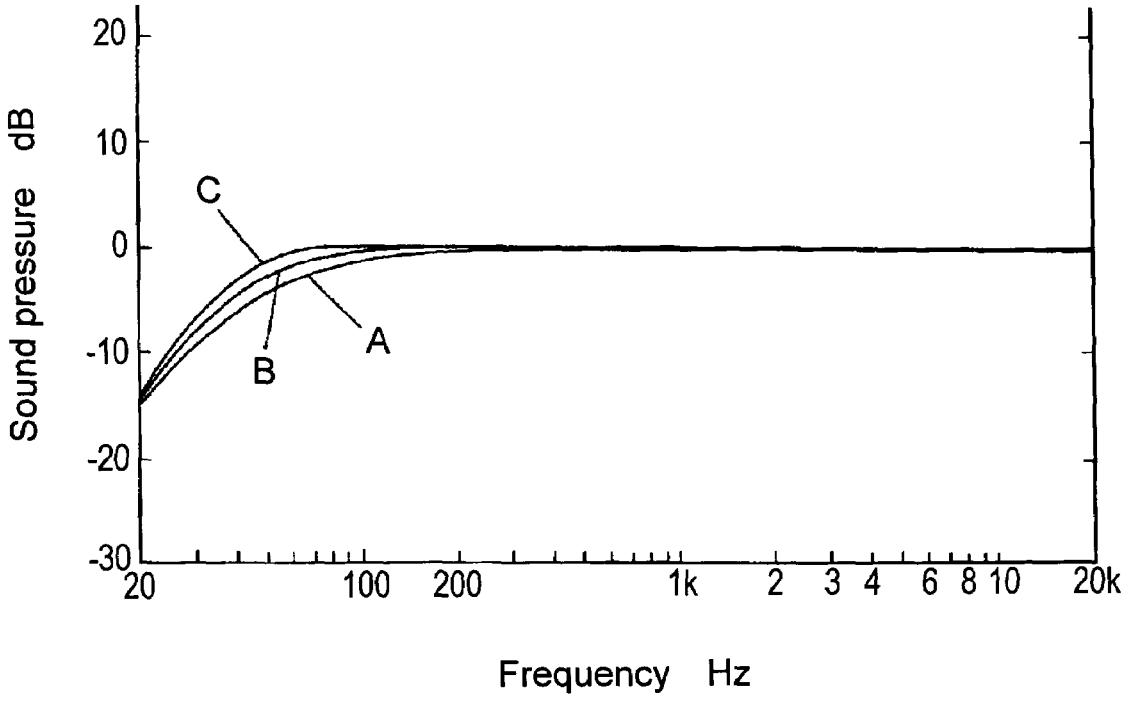
FIG. 8 illustrates a characteristic view explaining embodiment 1 of the present invention.
Figure 9:
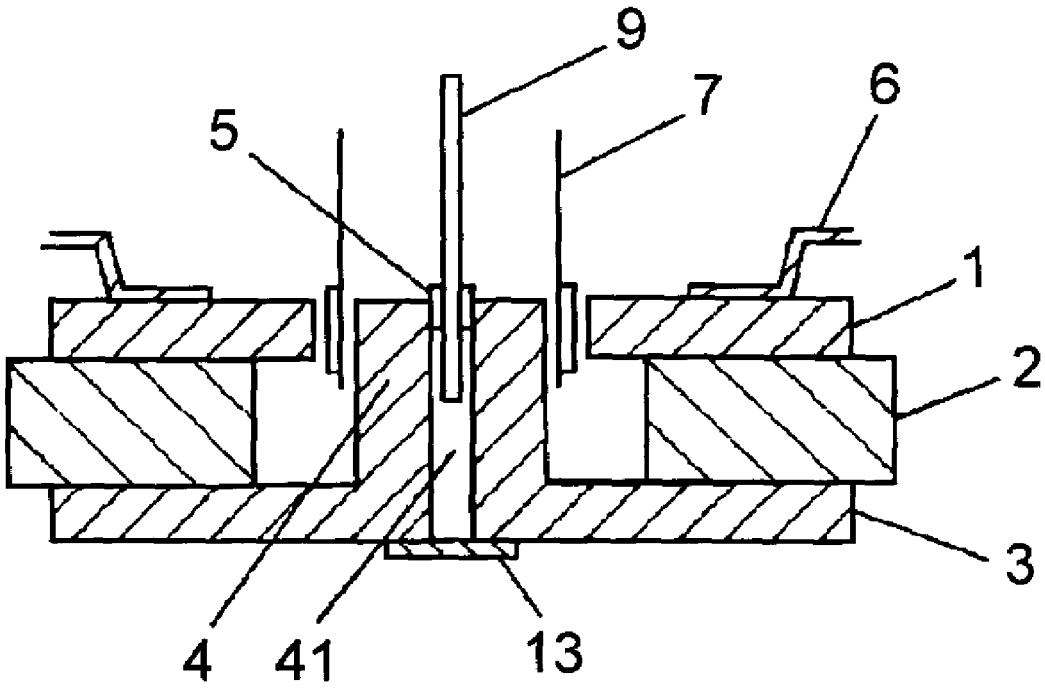
FIG. 9 illustrates a cross sectional view explaining embodiment 1 of the present invention.

FIG. 8 shows a frequency vs. sound pressure characteristic for respective viscosities of magnetic fluid 12, 2000 mPa·sec for A, 1000 mPa·sec for B and 500 mPa·sec for C. Viscosity of magnetic fluid 12 can control damping factor of a speaker. As mentioned above, magnetic fluid can be adjusted to a required Q value by viscosity control.

Another configuration in exemplary embodiment 1 is to apply sealing material 13 composed of a porous material to end face of through-hole 41 of central pole 4 on bottom yoke to prevent foreign materials (e.g. iron powder) entering from outside. Porous material having an infinite number of micro-holes retains air permeability so that it can prevent foreign materials from outside without undesired influence on speaker characteristics.

Exemplary Embodiment 2

Figure 10:
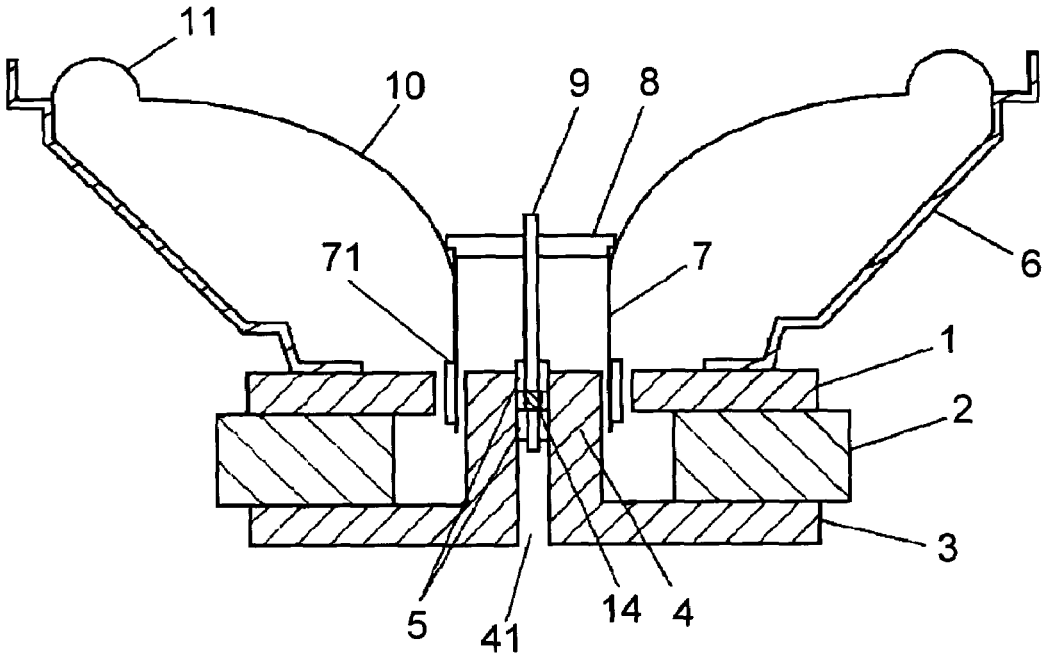
FIG. 10 illustrates a cross sectional view explaining embodiment 2 of the present invention.
Figure 11:
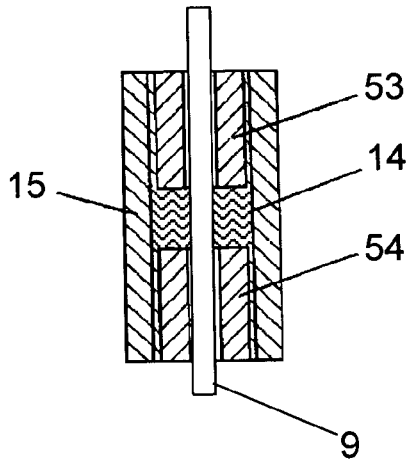
FIG. 11 illustrates a cross sectional view of a bearing used in exemplary embodiment 2 of the present invention.

FIG. 10 illustrates a cross-sectional view of a speaker disclosed in exemplary embodiment 2 of this invention.

The speaker shown in FIG. 10 comprises: (a) ring shaped top yoke 1, (b) ring shaped magnet 2, (c) bottom yoke 3 incorporated with central pole 4, (d) bearing 5 fixed to central pole 4, (e) frame 6 fixed to top yoke 1, (f) voice coil bobbin 7 fixed to internal circumference of diaphragm 10 and (g) voice coil 71 wound on bobbin 7. Central cap 8 fixed to internal circumference of bobbin 7 is coupled to bobbin so that upper end face of bobbin 7 is capped.

Moreover, the speaker comprises: (h) shaft 9 fixed in the center of central cap 8, (i) edge 11 provided on external circumference of diaphragm 10 and fixed to frame 6, and (h) lubricant 14 filled in a gap of bearing 5. Bearing 5 has a configuration such that upper bearing piece 53 and lower bearing piece 54 are disposed keeping a predetermined gap between both pieces. In addition, bearing is placed in through-hole 41 provided at the center of central pole 4, and shaft 9 goes through bearing 5.

The configuration in exemplary embodiment 2, similar to exemplary embodiment 1, can decrease both of second harmonic distortion and third harmonic distortion much more than conventional speakers.

The configuration using no damper can produce a speaker having excellent characteristics without occurrence of sliding noise.

Also in exemplary embodiment 2, as described in exemplary embodiment 1, a configuration to provide a bearing composed of a self-lubricating resin can prevent sliding noise.

Also in exemplary embodiment 2, similar to exemplary embodiment 1, a configuration to provide a shaft composed of a non-magnetic metal can work up-and-down vibration movement smoothly.

Also in exemplary embodiment 2, similar to exemplary embodiment 1, shaft 9 composed of magnetic metal can provide a speaker with so called electro-magnetic damping effect. When the speaker has such configuration, vibration system can move vertially (up-and-down) with a point as a center (reference point), which is the point in the through-hole 41 by 7 mm down from upper surface of central pole 4.

Also in exemplary embodiment 2, similar to exemplary embodiment 1, a configuration of shaft diameter ranging from 1 mm to 3 mm can minimize an effect of weight increase in vibration system.

Also in exemplary embodiment 2, a speaker can have a high reliability when clearance between bearing and shaft has a range setting from 0.008 mm to 0.015 mm.

Also in exemplary embodiment 2, a configuration to provide a through-hole of central pole with a sealing material composed of a porous material can prevent foreign materials from coming into the through, while air permeability is being maintained.

Exemplary embodiment 2 has a configuration to have a structure to hold two bearing pieces 53 and 54 by a cylindrical metal 15 to obtain accurate arrangement. The arrangement enables to hold and fix two bearing pieces 53 and 54 accurately. A gap provided between two bearing pieces 53 and 54 is filled with lubricant 14 as shown in a cross-sectional view of FIG. 11. As described above, pre-assembly of a composite part consists of two bearing pieces 53 and 54 filled with lubricant 14 in between can keep accuracy of bearing and can improve working efficiency of a speaker assembly.

Also in exemplary embodiment 2, an excellent speaker can be produced with a silicon based lubricant, a speaker free from sliding noise under aging phenomena and ambient temperature cycling. Or a fluorine-containing lubricant can provide same effects.

Exemplary Embodiment 3

Figure 12:
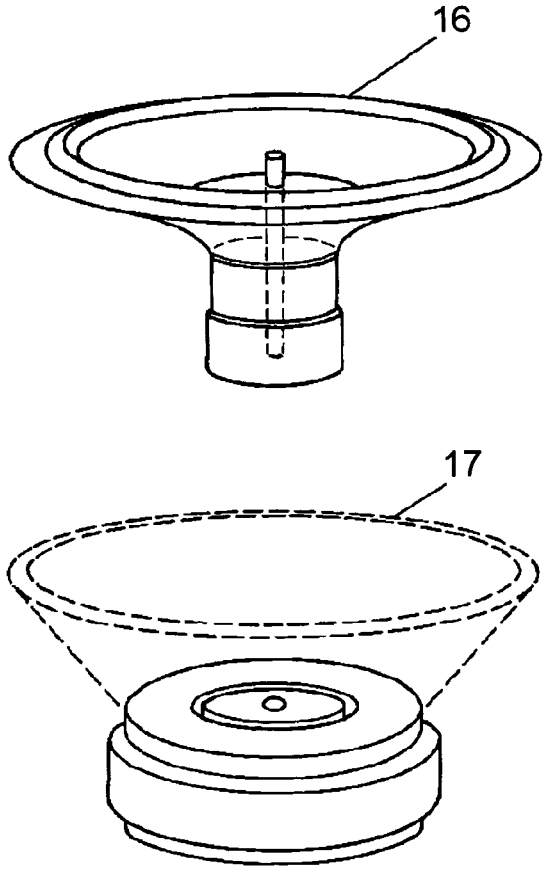
FIG. 12 illustrates a perspective assembly view of a manufacturing method of a speaker used in exemplary embodiment 3 of the present invention.

FIG. 12 illustrates a schematic view of an assembly method disclosed in exemplary embodiment 3 of this invention. An assembly method of a speaker shown in FIG. 1 comprises:

firstly, providing vibration system assembly 16 consists of (a) diaphragm 10, (b) edge 11, (c) central cap 8 on which shaft 9 is fixed, (d) voice coil 71 fixed to internal circumference of diaphragm 10 and having a central cap fixed to its internal circumference, and secondly, providing magnet assembly 17 consists of (e) top yoke 1, (f) magnet 2, (g) bottom yoke 3 fixed to frame 6, and further fixed to bearing 5.

Finally, using bearing 5 fixed to central pole 4 as a guide, and inserting shaft 9 into bearing 5 for positioning, edge 11 is fixed on frame 6, after assembling vibration system assembly 16 and magnet assembly 17.

This assembly method enables to produce a speaker with high accuracy and improved working efficiency, as respective parts can be assembled accurately and relative positioning to central pole is provided finally according to shaft 9 and bearing 5.

Example for Comparison

Figure 13:
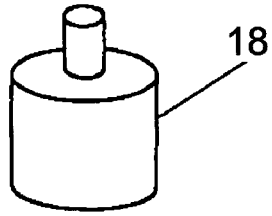
FIG. 13 illustrates a perspective view of a spacer used in assembling process of a conventional speaker.
Figure 14:
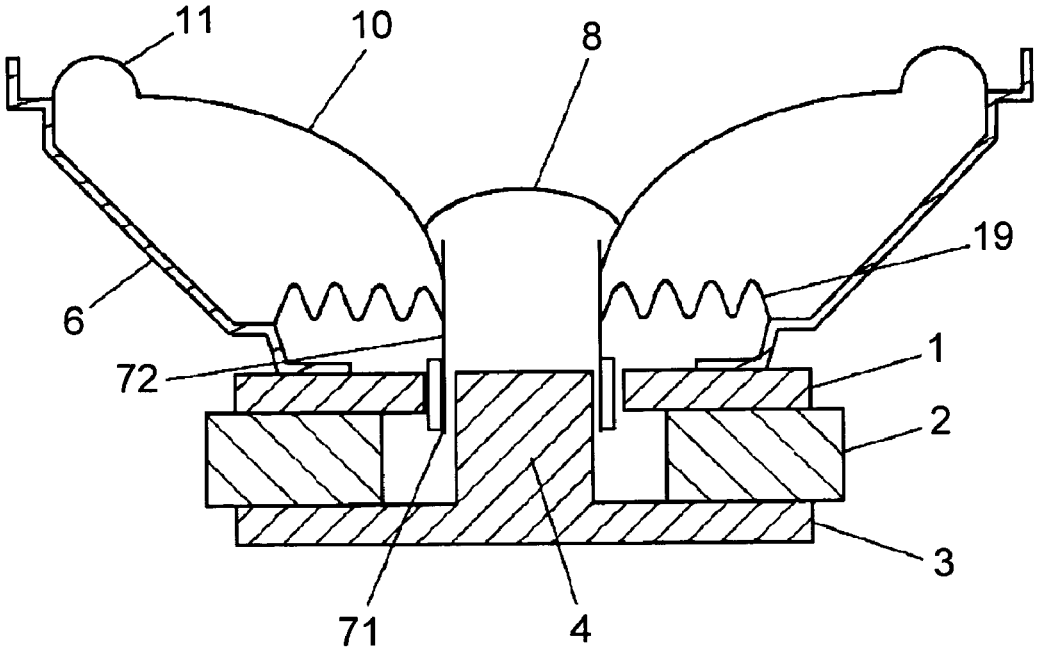
FIG. 14 illustrates a cross sectional view of a conventional speaker.

In a conventional art, spacer 18 shown in FIG. 13 is used as a jig to fix voice coil in the center of central pole 4. In a conventional method, as shown in FIG. 14, center of bearing and position of shaft 9 are easy to skew due to following assembling steps:

fixing voice coil bobbin 72 on central pole 4 using spacer 18, gluing voice coil bobbin 72 on internal circumference of diaphragm 10, gluing edge 11 on frame 6, and after drying taking out spacer 18, then mounting and gluing central cap 8.

INDUSTRIAL APPLICABILITY

The speaker disclosed in this invention, comprising no damper, has excellent characteristics without occurrence of rolling phenomena or generation of sliding noise and with low harmonic distortion.

What is claimed is:

1. A speaker comprising:

(a) a magnetic circuit having a through-hole provided in a center thereof;

(b) a frame fixed to said magnetic circuit;

(c) a diaphragm fixed to said frame;

(d) a bobbin having a wound voice coil housed on internal circumference of said diaphragm;

(e) a central cap fixed to said bobbin;

(f) a shaft fixed in the center of said central cap and further protruding toward a front of said diaphragm; and (g) a bearing fit in said through-hole, wherein said shaft fits in said bearing with a clearance, and lubricant is held between said bearing and said shaft.

2. The speaker of claim 1, wherein said bearing has a larger inner diameter portion in a central part of said bearing so that said lubricant is filled in the larger diameter portion.

3. The speaker of claim 1, wherein said bearing comprises an upper bearing piece and a lower bearing piece, and a prescribed gap between said upper bearing piece and said lower bearing piece is given to keep said lubricant.

4. The speaker of claim 3, wherein said upper bearing piece and lower bearing piece are disposed inside of a metal cylinder with a prescribed gap between them.

5. The speaker of claim 1, wherein said lubricant is a silicone based lubricant or fluorine containing lubricant.

6. The speaker of claim 1, wherein said bearing is mounted at a position on the center axis of said magnetic circuit where leakage flux shows the maximum value, and said lubricant is a magnetic fluid.

7. The speaker of claim 6, wherein Q value is adjusted to a required value using said magnetic fluid having a prescribed viscosity.

8. The speaker of claim 6, wherein said bearing has a larger inner diameter portion in upper part of said bearing to hold said lubricant.

9. The speaker of claim 1, wherein said bearing is composed of a self-lubricating resin.

10. The speaker of claim 1, wherein said shall is composed of a non-magnetic metal.

11. The speaker of claim 1, wherein said shaft is composed of a magnetic metal, and bottom end of said shaft is housed in a prescribed position of said through-hole.

12. The speaker of claim 1, wherein diameter of said shaft is in the range of 1 mm to 3 mm.

13. The speaker of claim 1, wherein said clearance between said shaft and said bearing is in a range of 0.008 mm to 0.015 mm.

14. The speaker of claim 1, wherein a porous material seals said through-hole on a bottom surface of said magnetic circuit.

15. The speaker of claim 6, wherein said bearing is composed of a self-lubricating resin.

16. The speaker of claim 6, wherein said shaft is composed of a non-magnetic metal.

17. The speaker of claim 6, wherein said shaft is composed of a magnetic metal, and bottom end of said shaft is housed in a prescribed position of said through-hole.

18. The speaker of claim 6, wherein diameter of said shaft is in the range of 1 mm to 3 mm.

19. The speaker of claim 6, wherein said clearance between said shaft and said bearing is in a range of 0.008 mm to 0.015 mm.

20. The speaker of claim 6, wherein a porous material seals said through-hole on a bottom surface of said magnetic circuit.

* * * * *

UNITED STATES PATENT AND TRADEMARK OFFICE

CERTIFICATE OF CORRECTION

PATENT NO. : 7,024,015 B2
APPLICATION NO. : 10/380043
DATED : April 4, 2006
INVENTOR(S) : Akinori Hasegawa et al.

It is certified that error appears in the above-identified patent and that said Letters Patent is hereby corrected as shown below:

Col. 8, Claim 10, line 1, change “shall” to --shaft--.

Signed and Sealed this

Eighth Day of August, 2006

JON W. DUDAS
*Director of the United States Patent and Trademark Office*